United States Patent [19]

Wurtz et al.

[11] 4,297,082

[45] Oct. 27, 1981

[54] VACUUM GETTERING ARRANGEMENT

[75] Inventors: Howard P. Wurtz; Eugene W. Peterson, both of Santa Barbara, Calif.

[73] Assignee: Hughes Aircraft Company, Culver City, Calif.

[21] Appl. No.: 96,583

[22] Filed: Nov. 21, 1979

[51] Int. Cl.[3] ..... F04B 37/02

[52] U.S. Cl. ..... 417/51; 417/53

[58] Field of Search ..... 417/48, 41, 53; 313/176, 180, 174, 178, 179

[56] References Cited

U.S. PATENT DOCUMENTS

| | | | |
|---|---|---|---|
| 2,855,368 | 10/1958 | Perdijk | 313/176 X |
| 3,195,716 | 7/1965 | Porta | 417/48 |
| 3,584,253 | 6/1971 | Wintzer | 417/51 X |
| 3,979,166 | 9/1976 | Zucchinelli | 417/48 |
| 4,146,497 | 3/1979 | Barosi et al. | 417/48 X |

OTHER PUBLICATIONS

"All-Glass Sorption Vacuum Trap", by F. B. Haller, *The Review of Scientific Instruments*, Vol. 35, No. 10, Oct. 1964.

*Primary Examiner*—William L. Freeh
*Assistant Examiner*—Edward Look
*Attorney, Agent, or Firm*—Allen A. Dicke, Jr.; W. H. MacAllister

[57] ABSTRACT

Vacuum gettering system includes first bulk getter 18 of zironium-aluminum alloy and having a heater 22 therein for activation. Second bulk getter 20 of porous silica glasse's is directly adjacent to getter 18 for heating activation. As vacuum enclosure 10 is pumped out, heater 22 heats both getters to activation temperature to drive off gases and vapors during low temperature enclosure baking and pumpout so that at enclosure closeoff both getters are fully activated.

19 Claims, 1 Drawing Figure

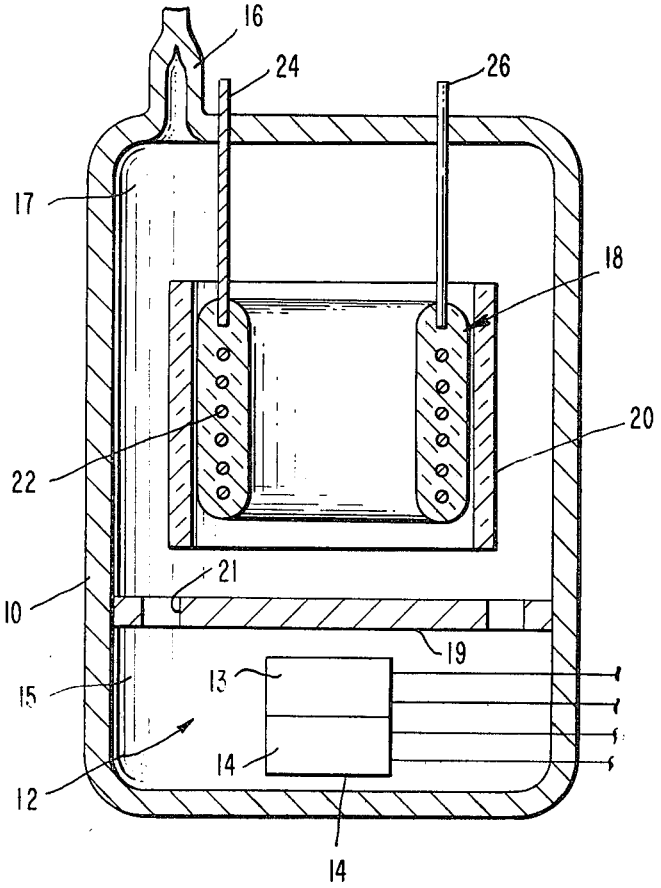
16
24
26
17
18
20
22
21
10
19
15
13
14
12
14

VACUUM GETTERING ARRANGEMENT

BACKGROUND

This invention is directed to a gettering system which permits the achievement of high vacuum in a permanantly sealed dewar for a long dewar life-time. The high vacuum is achieved by employing two getters, one of which is principally for water adsorption, and the other for light gas adsorption, with the two getters being closely related so that they can both be heated for activation during low temperature dewar baking and vacuum pumpout.

High vacuum devices such as certain lamps, electromagnetic tubes and the like, can be permanently sealed off and commonly retain a very high vacuum for long periods of time. This is achieved primarily by virtue of the fact that during manufacture and final evacuation the entire vacuum envelope is baked at high temperature to drive off water and other gas contaminants which are on the inner surfaces of the package. Following closure of the vacuum package, a small internal gettering device may be used to absorb any subsequent out-gassing that may take place in the package.

There is a considerable amount of prior art in gettering because it was an early problem in vacuum devices such as incandescent lights and radio vacuum tubes. MacRae U.S. Pat. No. 1,623,351 and Lockwood U.S. Pat. No. 2,449,786 are directed to early types of gettering structures. Lockwood discloses the use of a zirconium-aluminum getter material on filament support wires. Lester U.S. Pat. No. 2,117,735 and King U.S. Pat. No. 2,183,841 disclose multiple materials in the getter for different purposes. Barosi U.S. Pat. No. 4,146,497 has a considerable background on gettering materials, and particularily at adsorptive gettering materials. The entire disclosure of that patent is incorporated herein by this reference for background discussion. It is principally directed to an open cell metallic support for a zirconium-graphite getter material.

However, in specialized applications, high temperature baking may not be possible. This is particularily true in some dewar packages of refrigerated infrared detection devices where high temperature baking during the final evacuation may cause damage to some of the components in the infrared detection device. This in turn means that the burden for removal of gas and water contaminants is largely placed on the internal gettering devices. Previous such devices have not been fully capable of achieving the desired and required gettering.

SUMMARY

In order to aid in the understanding this invention it can be stated in essentially summary form that it is directed to a vacuum gettering system which includes a first getter, which has a heater wire embedded into a porous sintered getter material such as sintered zirconium-aluminum alloy and a second getter placed adjacent thereto for heating thereby. The second getter is porous silica glass having a large capacity for water adsorption.

It is thus an object of invention to provide a vacuum gettering system which is capable of gettering the residual gases in a vacuum space without high temperature baking of the space. It is another object to provide a vacuum gettering system which includes both a bulk getter which can be reactivated by heating and a porous silica water absorptive getter which can be reactiviated by heating so that during vacuum chamber pumpout, the two getters can be reactivated so that at the completion of pumpout and chamber sealing, both getters have been freshly reactivated to provide for a long vacuum life.

Other objects and advantages of this invention will become apparent from a study of the following portion of this specification, the claims and the attached drawings.

BRIEF DESCRIPTION OF THE DRAWINGS

The single FIGURE of the drawing is a central section through a sealed vacuum enclosure having the vacuum gettering system of this invention contained therein for maintaining vacuum.

DESCRIPTION OF THE PREFERRED EMBODIMENT

In the single FIGURE of the drawing, vacuum enclosure 10 encloses vacuum in space 12 which may contain electronic device 14 which is required to be held at vacuum during operation. When a glass vacuum enclosure is used, the glass surface does its own water vapor gettering. Thus, the enclosure used with the gettering system of this invention is usually a metal envelope. The enclosure may be a dewar housing. Other types of vacuum requiring equipment may be placed in enclosure 10, but in the present instance refrigerated infrared detection devices are the particular example of a electronic device 14, because such are not usually of such construction that they can be subjected to high temperature baking which drives off a substantial portion of the absorbed water vapor and gases during vacuum pumpout period. A thermo-electric cooler 13 with a radiation sensor 14 is an example of such a device. In such a case the enclosure is a vacuum insulating dewar. Chamber 12 and dewar 10 are divided into subchambers 15 and 17 by wall 19 which has a pair of openings 21 therethrough. The chambers 15 and 17 respectively contain radiation sensor 14 with its thermo-electric cooler 13 and the vacuum gettering structure. Ports 21 permit gas communication between subchambers 15 and 17 but obstruct direct radiant communication. Vacuum enclosure 10 is provided with pumpout port 16 which is connected to a vacuum pump during the vacuum pumping operation. Port 16 is shown in the drawing as being sealed off by pinching off the metal tube neck after vacuum pumping has been completed.

The vacuum gettering system of this invention comprises a first bulk gettering device 18 and a second bulk gettering device 20. For the purposes of this invention, bulk gettering is defined as an absorptive or absorptive surface active gettering process. The gas to be gettered is attached to the surface of the material by the usual surface active forces. Bulk gettering systems can be reactivated by heating, where the heating is sufficiently high to drive off the absorbed or absorbed gases. Bulk gettering is reversible, and thus is contrasted to the chemical reaction type of gettering, for example where oxygen is gettered by oxidizing magnesium to permanently attach the oxygen.

First gettering device 18 is a bulk getter such as a sintered zirconium-aluminum alloy which is an absorbtive structure which is particularily capable of absorbing gases. It contains heater coil 22 which can be externally electrically energized through leads 24 and 26 for heating the gettering material of getter 18. Applying a suitable electric current to the heater wire 22 when the getter is in a vacuum or inert atmosphere causes the entire sintered mass to be heated to a temperature which will remove an otherwise stable layer of oxides formed on the surface of this getter, to thus activate the getter. If there were no temperature limits on baking the vacuum enclosure, then it could be baked at a temperature of at least about 300° C., 575° F., to thus bake out the substantial quantities of water and other gases which are often present. However, when the electronic device 14 limits the baking temperature, for example to about 75° C., 170° F., then the water which is left behind may become an overwhelming load if only the first gettering device 18 is employed. The first gettering device 18 is a commercially available getter, for example, Item ST171/HI/7-6/150 available from SAES Getters U.S.A., 1122 E. Cheyenne Mountain Boulevard, Colorado Springs, Colo. 80906.

In accordance with this invention the second bulk gettering device 20 is positioned directly adjacent to the first gettering device 18. In the present case, both of the gettering devices are annular, with the second gettering device 20 on the exterior. The second gettering device is in the shape of a cylindrical tube. Second gettering device 20 is made of "Thirsty Vycor" which is a trade name of Corning Glassworks for Number 7930 high silica porous glass. The high silica porous glass is made by leaching the nonsilica materials from a special glass to leave a porous silica structure. The high silica porous glass is highly adsorptive to water vapor.

In this combination, during pumpout of the vacuum enclosure 10, first getter device 18 is heated by energizing its heater through electric leads 24 and 26 to simultaneously heat the second getter device 20. The heating of getter 18 removes the otherwise stable layer of oxides formed on the surface of the porous getter and simultaneously the porous silica glass of second getter 20 is heated. The water present in the silica is driven off and withdrawn by the dynamic vacuum pump connected to evacuate enclosure 10. During the heating process wall 19 acts as a radiation shield which prevents direct radiant heat transfer from the heated getters 18 and 20 to the equipment in subchamber 15, particularly thermoelectric cooler 13 and its associated infrared detector 14. Thus, on completion of the heating of both the gettering devices 18 and 20, with pumpout of the vacuum enclosure and sealing thereof, both the gettering devices are prepared for their absorption functions.

The use of the porous silica getter 20 in the combination provides for adsorbing large amounts of water vapor, and its activation while in the enclosure and under vacuum provides for a method for activating it after it has been exposed to surrounding sources of water during assembly. With this method the evacuation bake temperatures after assembly in the vacuum enclosure may be kept low. The separate activation of the bulk getter 18 and porous silica getter 20 permits them to be raised to a suitable activation temperature. This activation temperature is strictly localized heating during the activation of the getters 18 and 20. This local heating to about 450° C., 900° F. activates the two getters without applying a high baking heat to the remaining components. Both the alloy bulk getter 18 and the porous silica bulk getter 20 have exceedingly large gettering capacity for their physical size so that gas and water contaminants can be gettered out during many years of vacuum life for the vacuum enclosures described above.

An operable combination also comprises the use of barium or magnesium first getter with a heater which can initially raise it to a second getter activation temperature during pumpout and later to a first getter flash temperature. This flashing getter would be used in association with a second bulk getter as described above. In use, during pumping the first getter would activate the second bulk glass getter. Then when the enclosure is sealed the first getter would be heated to flash temperature where it would oxidize to consume remaining oxidant gases.

This invention has been described in its presently contemplated best mode and it is clear that it is susceptible to numerous modifications, modes and embodiments within the ability of those skilled in the art and without the exerise of the inventive faculty. Accordingly, the scope of this invention is defined by the scope of the following claims.

We claim:

1. A vacuum gettering system comprising:

a first getter, said first getter being a bulk getter;

a second getter, said second getter being a bulk getter;

a vacuum enclosure enclosing both said first and second getters in communication with each other; and means for heating both said first and second getters so that when gas is pumped from said vacuum enclosure, said second getter can be heated to an activation temperature to drive off adsorbed gases on said second getter to activate said second getter without high temperature baking of the entire vacuum enclosure.

2. The vacuum gettering system of claim 1 wherein said first bulk getter is a zirconium-aluminum alloy bulk getter.

3. The vacuum gettering system of claim 1 wherein an electronic device is also positioned within said vacuum enclosure so that said gettering system maintains vacuum on said electronic device over a long period.

4. A vacuum gettering system comprising:

a first bulk getter, said first bulk getter being made of a zirconium-aluminum alloy;

a second bulk getter, said second bulk getter being a porous silica water vapor adsorbing bulk getter;

a vacuum enclosure enclosing both said first and second getters in communication with each other; and means for heating both said first and second getters so that when gas is being pumped from said vacuum enclosure said second getter can be heated to an activation temperature to drive off adsorbed gases on said second getter to activate said second getter without high temperature baking of the entire vacuum enclosure.

5. The vacuum gettering system of claim 4 wherein said first bulk getter has an electric heater directly associated therewith.

6. A vacuum gettering system comprising:

a first bulk getter, said first bulk getter being made of a zirconium-aluminum alloy; and a second bulk getter, said second bulk getter being a porous silica water vapor adsorbing bulk getter;

a vacuum enclosure enclosing both said first and second bulk getters in communication with each other; and means for heating both said first and second bulk getters, said means for heating comprising an electric heater directly associated with said first bulk getter comprising a heater coil within said first bulk getter so that when gas is being pumped from said vacuum enclosure said second getter can be heated to an activation temperature to drive off adsorbed gases on said second getter to activate said second getter without high temperature baking of the entire vacuum enclosure.

7. The vacuum gettering system of claim 6 wherein said first and second getters are tubular and one of said getters is positioned within the other of said getters.

8. The vacuum gettering system of claim 7 wherein said first bulk getter is positioned within said tubular second bulk getter.

9. The vacuum gettering system of claim 8 wherein an electronic device is also positioned within said vacuum enclosure so that said gettering system maintains vacuum on said electronic device over a long period.

10. A vacuum gettering system comprising:

a first getter, said first getter being a bulk getter;

a second getter, second getter being a porous silica water vapor adsorbing bulk getter;

a vacuum enclosure enclosing both said first and second bulk getters in communication with each other; and means for heating both said first and second getters so that when gas is being pumped from said vacuum enclosure said second getter can be heated to an activation temperature to drive off adsorbed gases on said second getter to activate said second getter without high temperature baking of the entire vacuum enclosure.

11. The vacuum gettering system of claim 10 wherein said first getter has an electric heater directly associated therewith.

12. The vacuum gettering system of claim 11 wherein said first and second getters are tubular and one of said getters is positioned within the other of said getters.

13. The vacuum gettering system of claim 12 wherein an electronic device is also positioned within said vacuum enclosure so that said gettering system maintains vacuum on said electronic device over a long period.

14. The method of providing and maintaining a vacuum in a vacuum enclosure having a device therein adversely affected by high baking temperatures comprising the steps of:

positioning an aluminum-zirconium first bulk gettering device within said vacuum enclosure;

positioning a porous silica second bulk gettering device within the vacuum enclosure and providing a heater within said vacuum enclosure for locally heating both of the bulk getters to activation temperature without heating the device to degradation temperature;

drawing a vacuum on the vacuum enclosure while heating both of the bulk getters to drive gases and vapors off the bulk getters for activating the bulk getters and drawing the gases and vapors out of the vacuum enclosure; and closing the vacuum enclosure so that the activated bulk getters can absorb gases and vapors to maintain vacuum in the vacuum enclosure.

15. The method of claim 14 wherein the vacuum drawing step and the heating for getter activation step are at least partly simultaneously performed.

16. The method of claim 15 wherein the vacuum enclosure contains a device having an upper limit critical temperature lower than the activating heating temperature of the bulk getters and further comprises the step of protecting the device against heating to a temperature above its critical temperature while the bulk getters are heated to their activation temperature above the device critical temperature.

17. The method of claim 14 wherein the vacuum enclosure contains a device having an upper limit critical temperature lower than the activating heating temperature of the bulk getters and further comprises the step of protecting the device against heating to a temperature above its critical temperature while the bulk getters are heated to their activation temperature above the device critical temperature.

18. The method of providing and maintaining a vacuum enclosure having a device therein adversely affected by high baking temperatures comprising the steps of:

positioning a first bulk getter within the vacuum enclosure;

positioning a porous silica second bulk getter within the vacuum enclosure;

positioning a heater in thermal association with the porous silica bulk getter for locally heating the porous silica bulk getter to activation temperature without heating the device within the enclosure to degradation temperature;

drawing a vacuum on the vacuum enclosure while heating the porous silica bulk getter to drive gases and vapors off of the bulk getter for activating the bulk getter and drawing the gases and vapors out of the vacuum enclosure; and closing the vacuum enclosure so that the activated porous silica bulk getter can absorb gases and vapors to maintain vacuum in the vacuum enclosure.

19. A vacuum system comprising:

a vacuum enclosure;

a device within said vacuum enclosure, said device being adversely by raising said device to high temperature;

a first bulk getter within said vacuum enclosure;

a porous silica second bulk getter within said vacuum enclosure in communication with said device and said first bulk getter; and a heater in thermal communication with said porous silica bulk getter and out of substantial thermal communication with said device so that said heater can heat said porous silica bulk getter to activation temperature without heating said device to degradation temperature.

* * * * *